US005330011A

United States Patent [19]

Powell

[11] Patent Number: 5,330,011

[45] Date of Patent: Jul. 19, 1994

[54] FREE FALL STROKER APPARATUS AND METHOD

[75] Inventor: Gary T. Powell, Avoca, Pa.

[73] Assignee: The George E. Failing Company, Enid, Okla.

[21] Appl. No.: 959,363

[22] Filed: Oct. 13, 1992

[51] Int. Cl.[5] ..... E02D 7/08

[52] U.S. Cl. ..... 173/1; 173/81; 173/86; 173/89

[58] Field of Search ..... 173/1, 81, 82, 86, 87, 173/89, 88

[56] References Cited

U.S. PATENT DOCUMENTS

| | | | |
|---|---|---|---|
| 2,500,879 | 3/1950 | Smallpeice . | |
| 2,919,109 | 12/1959 | Minty . | |
| 3,216,511 | 11/1965 | Ladd et al. | 173/89 |
| 3,278,162 | 10/1966 | Akins et al. . | |
| 3,669,411 | 6/1972 | McKendrick . | |
| 3,856,266 | 12/1974 | McKendrick . | |
| 4,142,709 | 3/1979 | Giessler . | |
| 4,166,508 | 9/1979 | van den Berg . | |
| 4,455,013 | 6/1984 | Fischer et al. . | |
| 4,580,640 | 4/1986 | Boldt | 173/82 |
| 4,638,978 | 1/1987 | Jordan . | |
| 4,844,661 | 7/1989 | Martin et al. | 173/81 |
| 4,852,661 | 8/1989 | Ellington | 173/89 |
| 4,977,965 | 12/1990 | Rupe | 173/89 |

*Primary Examiner*—Scott Smith

*Attorney, Agent, or Firm*—Litman, McMahon & Brown

[57] ABSTRACT

A free fall stroker for raising and dropping a drop hammer for soils bearing testing or the like includes a housing through which a drop hammer cable extends from one side to the bottom thereof. A pair of guide pulleys guide the cable through the housing and a movable sheave operates within a parallelogram-shaped track with four legs, and is attached to a telescoping arm of a hydraulic stroking cylinder. When the arm is retracted, the sheave is moved in a first leg of the track and engages the cable, pulling it between the guide pulleys. When the sheave reaches the end of the first leg, it moves in a second leg in a second direction away from the guide pulleys. This causes the cable to be released, thus dropping the drop hammer and letting it free fall. Extension of the telescoping arm then returns the sheave to the point of origin via the third and fourth legs of the track. A winch is provided on top of the housing to adjust the cable length and a stroke counter counts the number of hammer strokes.

29 Claims, 2 Drawing Sheets

FREE FALL STROKER APPARATUS AND METHOD

BACKGROUND OF THE INVENTION

1. Field of the Invention

The present invention relates to a free fall stroker for raising and releasing a drop hammer attached to a cable, and in particular to a compact, hydraulically driven, horizontally movable pulley assembly for engaging, raising and releasing a cable attached to the hammer for precisely controlling the hammer movement in a soil testing apparatus.

2. Description Of the Related Art

An established procedure for testing soils density and composition involves taking a core sample every five feet for analysis. To accomplish this, first a drilling rig drills a five foot deep hole using a hollow bore auger. A core sampler, which comprises a pipe section, which may be 16", 24" or 30" long and which has a 2" outside diameter and a 1.5" inside diameter and an attached 140 lb. drop hammer which is dropped 30". The density of the soil being tested is determined based upon the number of drop strokes required to drive the sampler a set distance into the soil. In order to operate within the drilled holes, the weights used generally take the form of a cylindrical drop hammer. For accurate testing, the drop length must be precisely controlled.

Typical prior art drop hammers include a hammer head attached to a cable which is reeled onto a winch spool. Once the hammer is raised to the desired height, the spool is released, thus dropping the hammer.

In such systems, a number of problems can occur. For example, the cable can bind as it is wound onto the winch spool, which prevents the hammer from dropping when the spool is released. Furthermore, winch release mechanisms are not always reliable, can inadvertently trip, and tend to slow the descent of the hammer due to friction within the spool itself. While these problems are not necessarily critical in a drop hammer used for pile driving or chiseling, for example, they are completely unacceptable in a soil testing apparatus which requires precise control.

It is clear then, that an improved apparatus and method for raising and releasing a drop hammer is needed. Such an apparatus should be compact and inexpensive, extremely reliable and rugged, should permit the drop hammer to drop in a virtual free fall, with little or no retarding action due to friction within the apparatus, and should allow repeated identical hammer drops to achieve precise soil bearing capacity measurements.

SUMMARY OF THE INVENTION

In the practice of the present invention, a free fall stroker apparatus and method are provided for reliably raising and releasing a drop hammer with a soil sampler attached. The apparatus comprises a housing within which a track block is positioned with a grooved track cut therein. The track comprises two long parallel track grooves connected by two relatively short parallel angled connecting grooves which collectively form a parallelogram. A movable pulley or "sheave" with a shallow cable engaging lip is attached to a support which, in turn, is pivotally connected to a roller cam operating within the track. The support is also attached to a telescoping arm of a hydraulic stroking cylinder. A drop hammer cable extends through the housing from one side, over a pair of guide pulleys and then out the bottom. The pair of guide pulleys, one near the top and one near the bottom of the housing, engage the cable and guide it through the housing. As the telescoping arm of the hydraulic stroking cylinder is retracted, the support and the attached sheave move in one direction following a first one of the long parallel track grooves. The sheave is aligned with the cable as it travels in the first long track groove and engages the cable, pulling it toward the stroking cylinder and thus raising the drop hammer. As the roller cam reaches the end of the first long track groove, it encounters a first of the short connecting track grooves and the support and the sheave are turned slightly as the cam roller enters the first short connecting groove. As the telescoping arm is retracted further, the roller cam follows the first connecting groove and the cable is released from the sheave lip, thus causing the hammer to free fall. The roller cam then enters the second long track groove and the telescoping arm is then extended, causing the roller cam to follow the second long groove and then the second short connecting groove in the opposite directions from those traveled in the first long groove and the first short connecting groove, respectively, thus returning the sheave to the point of origin. The hydraulic stroking cylinder is pivotally mounted to permit the telescoping arm to align with either parallel groove. A stroke counter counts and displays the number of hammer strokes.

The drawings constitute a part of this specification and include exemplary embodiments of the present invention and illustrate various objects and features thereof.

OBJECTS AND ADVANTAGES OF THE INVENTION

The principle objects and advantages of the present invention include: providing a free fall stroker apparatus and method for raising and releasing a drop hammer or the like attached to a cable; providing such an apparatus with a housing through which the cable passes, the housing including a pair of guide pulleys for engaging the cable; providing such an apparatus in which a movable sheave engages the cable and pulls it between the guide pulleys, thus raising the attached drop hammer; providing such an apparatus in which the sheave is attached to a roller cam operating within parallelogram-shaped track; providing such an apparatus in which the roller cam is connected to a telescoping arm of a hydraulic stroking cylinder, the arm retracting to move the cam in one direction in the track to enable the sheave to engage the cable and in second direction to release the cable, and the arm extending to move the cam in directions opposite to the first and second directions to return to the point of origin; providing such an apparatus and method which allows a drop hammer to be raised reliably and efficiently and then to descend in a virtual free fall; providing a method of controlling a drop hammer which raises and releases a drop hammer without the use of a winch; providing a method of controlling a drop hammer which permits precise, repeated hammer drops making it suitable for use in soil bearing measurement apparatus; and providing such an apparatus and method which is particularly well adapted for its intended use.

Other objects and advantages of this invention will become apparent from the following description taken in conjunction with the accompanying drawings wherein are set forth, by way of illustration and example, certain embodiments of this invention.

DETAILED DESCRIPTION OF THE PREFERRED EMBODIMENTS

I. Introduction and Environment

Figure 1:
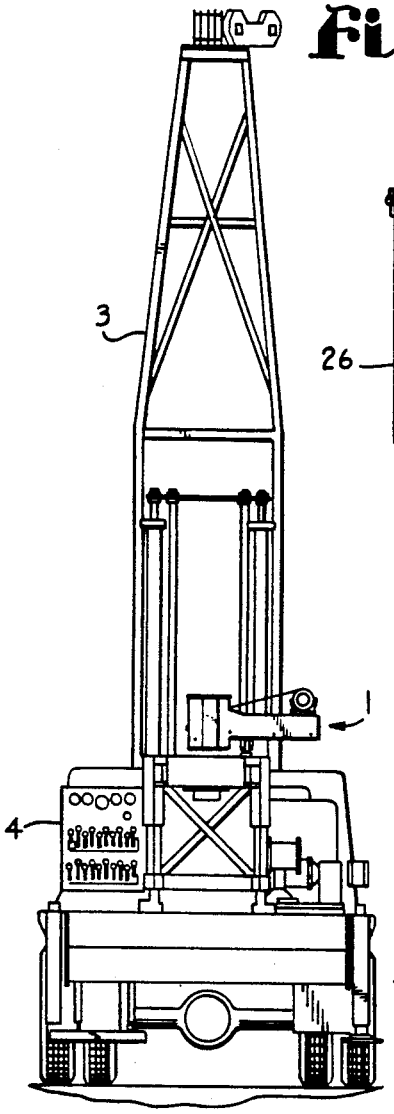
FIG. 1 is a perspective view of a truck carrying a drilling rig or the like and a free fall stroker apparatus embodying the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting For example, the words "upwardly", "downwardly" "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail the reference numeral 1 generally designates a free fall stroker apparatus in accordance with the invention, shown, for purposes of illustration, mounted on a drilling truck 2 with a drilling derrick 3. A control station 4 is provided for controlling the drilling derrick 3 and the free fall stroker apparatus 1. The free fall stroker 1 is of the type used in soils bearing capacity tests where a sampling pipe 6 is driven into the soil being tested by repeated blows from a drop hammer, such as the hammer 5 in FIG. 2. The bearing capacity can be determined by the number of blows it takes to drive the pipe into the soil. The drilling derrick 3 is used to drill repetitive five foot holes so that sampling can occur every five feet.

II. Free Fall Stroker

Figure 2:
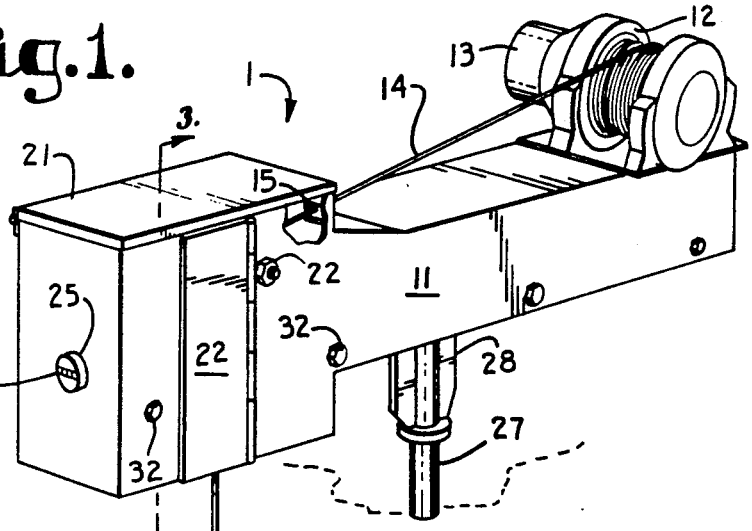
FIG. 2 is an enlarged perspective view of the free fall stroker.
Figure 3:
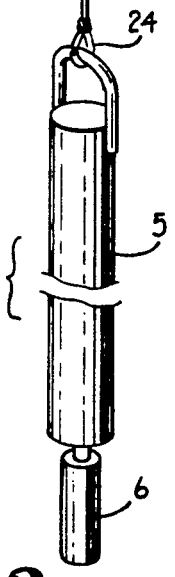
FIG. 3 is an enlarged cross-sectional view of the free fall stroker, taken along line 3—3 of FIG. 2.
Figure 3:
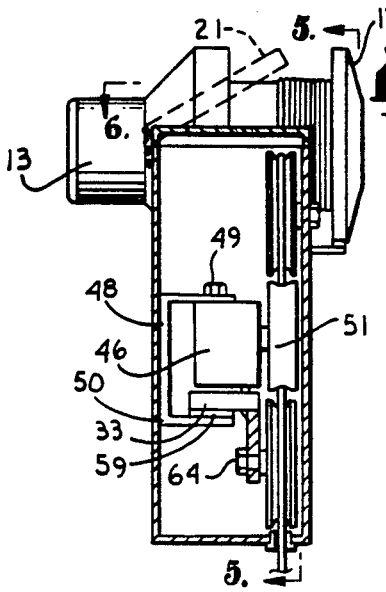
Figure 4:
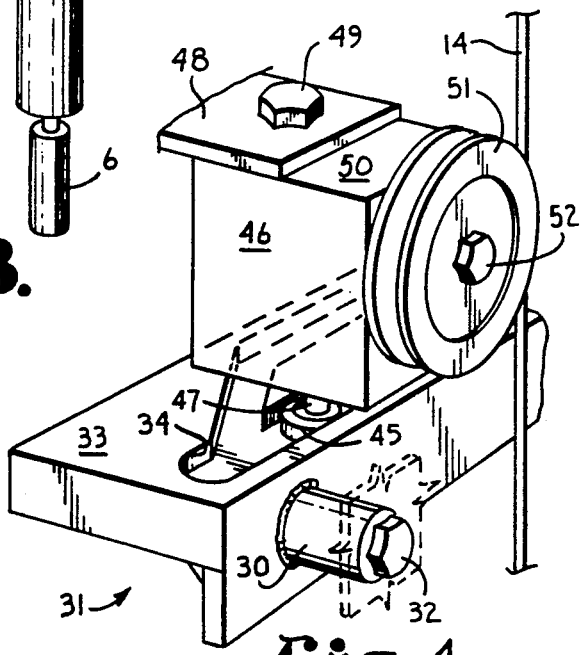
FIG. 4 is an enlarged perspective view of a track block with a movable sheave and support, carried by a roller cam operating within the track, and aligned with a cable.
Figure 5:
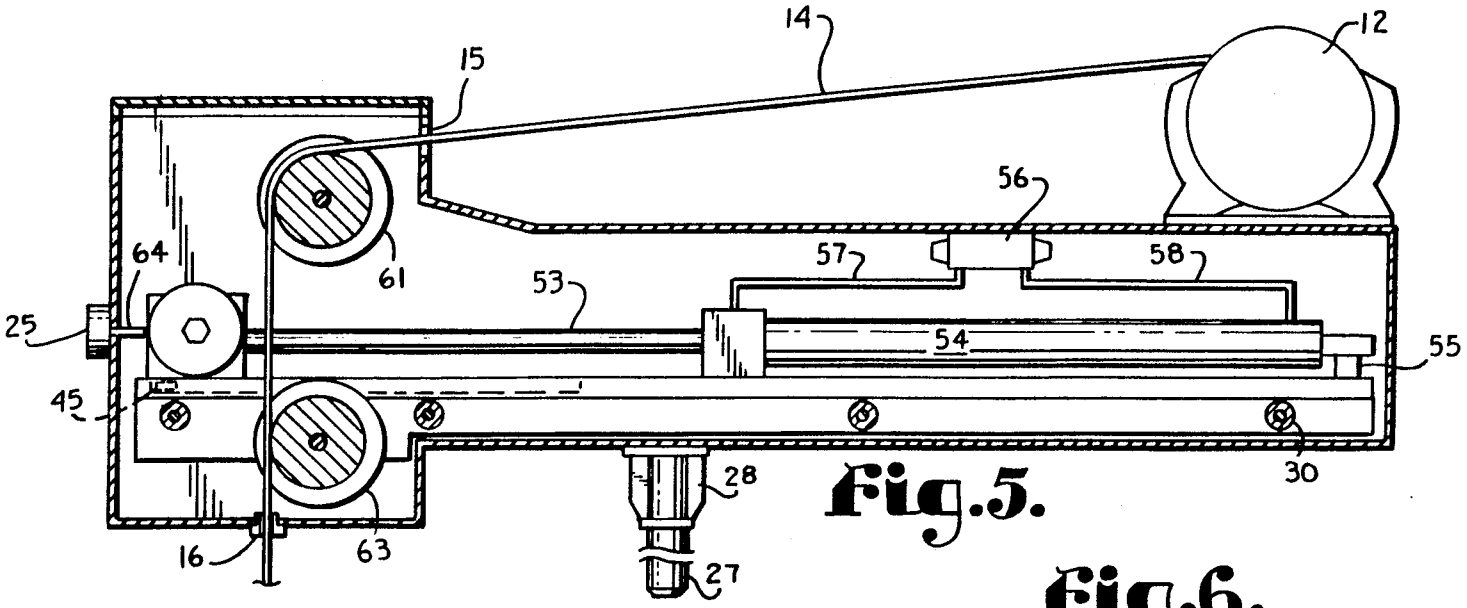
FIG. 5 is an enlarged cross-sectional view of the free fall stroker, taken along line 5—5 of FIG. 3.

FIGS. 2–7 illustrate the free fall stroker 1 in more detail. FIG. 2 shows the stroker 1 comprising a housing 11 with a winch reel 12 mounted on top of the housing 11. A motor 13 is attached to the winch reel 12 for rotating the reel 12. A cable 14, which may be a steel wire cable, is wound around the winch reel 12 and extends therefrom into a side slot 15 in the side of the housing 11. A bottom split bushing 16 is provided in the bottom of the housing 11 where the cable 14 exits. A top hinged access door 21 and a front hinged access door 22 are provided for gaining access to the interior of the housing 11. The drop hammer 5 is attached to the cable 14 via a clip 24. A hammer stroke counter 25 including a display 26 is mounted on the housing 11. The housing 11 is supported by a support shaft 27 and a support flange 28.

Within the housing 11, an "L" shaped track block 31 is mounted to the front of the housing 11 via a set of bolts 32 extending through a like plurality of sleeves 30. A horizontal leg 33 of the track block 31 includes a track 34 cut therein. The track 34 is configured as a parallelogram (FIG. 7) with two long parallel grooves 35 and 36 and two shorter, angled parallel grooves 41 and 42. The long grooves and 36 extend past the shorter angled grooves 42 and 41, respectively, to form an originating position 43 and a switching position 44. A cam roller 45 is sized and configured to roll within the track 34. A sheave support block 46 is pivotally attached to the cam roller 45 via a shaft 47. A "C" shaped retaining member 48 is attached to the block 46 via a screw 49. A bottom leg 50 of the retaining member 48 extends beneath the horizontal leg 33, and a resilient pad 59 is placed on top of the leg 50. The retaining member 48 keeps the block 46 properly positioned with respect to the horizontal leg 33 and the track 34. A sheave 51 is bolted onto the sheave support block 46 via a bolt 52. The sheave 51 has a relatively shallow cable engaging lip 50. The sheave support block 46 is rigidly connected to one end of a telescoping arm 53 of a hydraulic stroking cylinder 54. The cylinder 54 is pivotally attached to the housing 11 at a pivot point 55 at the end opposite the telescoping arm 53. A "smart" hydraulic switch valve 56 is attached to the top of the cylinder 54 via a pair of hydraulic hoses 57 and 58.

A top guide pulley 61 is attached near the top of the housing via a bolt 62 and a bottom guide pulley 63 is attached to the track block 31 via a bolt 64 near the bottom of the housing 11. The guide pulleys 61 and 63 are stationary and are sized and positioned to engage the cable 14 as it enters and exits the housing 11, respectively, and to rotate therewith as the cable is moved up or down relative to either pulley.

A trip switch 64 is mounted in the housing 11 near the left end thereof, and is attached to the stroke counter 25, which is adapted to increment the number displayed on the display 26 with each tripping of the switch 64.

III. Operation

Figure 6:
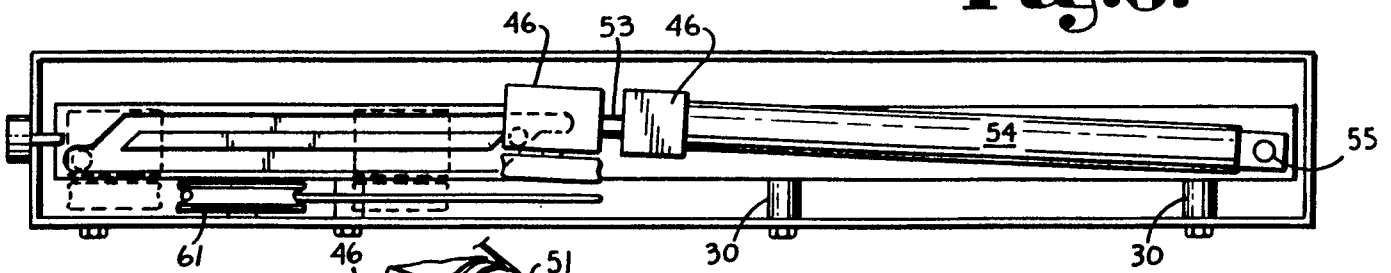
FIG. 6 is an enlarged top plan view of the free fall stroker, taken along line 6—6 of FIG. 3.
Figure 8:
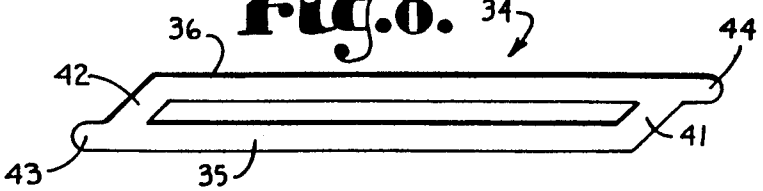
FIG. 8 is a schematic view of the track grooves illustrating the parallelogram shape of the track.
Figure 7:
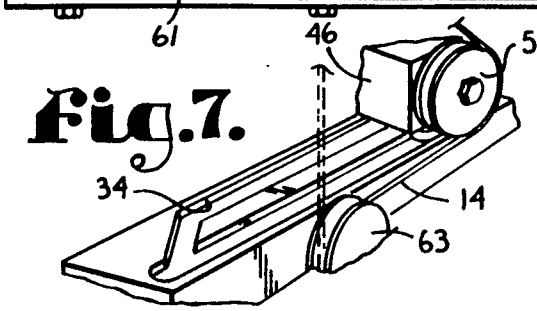
FIG. 7 is an enlarged and fragmentary perspective view of the movable sheave engaging the cable.

In operation, the drop hammer 5 and sampling pipe 6 are lowered to a position just in contact with the soil being tested by unreeling the cable 14 from the winch reel 12. A hammer drop cycle is initiated by enabling the smart hydraulic switch valve 56 which causes the hydraulic stroking cylinder to retract the telescoping arm 53. The arm 53 pulls the attached sheave support block 46 and the sheave 51 to the right as the cam roller 45 follows the track groove 35. This is illustrated in the successive positions shown in phantom in FIG. 6. The sheave 51 engages the cable 14 and draws it to the right, as shown in solid lines in FIG. 7. This raises the hammer 5 thirty inches into a position from which it can be dropped. As the cam roller 45 reaches the end of the groove 35, it then begins to follow the shorter groove 41, and the stroking cylinder 54 is pivoted horizontally at the pivot point 55, as is shown in FIG. 6. Since the sheave support block 46 is constrained to follow the longitudinal orientation of the telescoping arm 53, it pivots slightly relative to the cam roller 45. The sheave 51, with the shallow lip 50, pivots with the support block 46, and the cable 14 slips off of the sheave 51, as is shown in solid lines in FIG. 6. This releases the cable 14 and allows the hammer 5 to drop in a virtual free fall to drive the pipe 6 into the soil.

As the telescoping arm 53 continues to retract, the cam roller 45 follows the groove 41 to its conjunction with the groove 36, and thence into the switch position 44. The hydraulic switch valve 56 senses the end of the stroke of the telescoping arm 53 into the cylinder 54 and begins to charge the cylinder 54, causing the telescoping arm 53 to extend. This extension propels the cam roller 45 along the groove 36 and then the groove 42, terminating in the start position 43.

The entire process is repeated until the smart hydraulic switch valve 56 is disabled. The length of the cable 14 is adjusted via the winch reel 12 as the pipe 6 is driven into the ground. Each stroke is counted by the stroke counter 25 and displayed on the display 26. Each hammer stroke is identical in the force generated to the pipe 6 since the amount of cable raised and released is always the same. Thus, the apparatus and method is ideal for soil bearing testing.

It is to be understood that while certain forms of the present invention have been illustrated and described herein, it is not to be limited to the specific forms or arrangement of parts described and shown.

What is claimed and desired to be secured by Letters Patent is as follows:

1. A free fall stoker apparatus for raising and dropping a cable, comprising:

(a) a cable engaging means movable in at least three different directions, said cable engaging means engaging and raising the cable during motion in a first of said directions and releasing and dropping said cable during motion in a second of said directions, wherein said first and second directions are non-reciprocal.

2. The invention of claim 1, and further comprising:

(a) a track including track portions extending in said at least three different directions;

(b) a track engaging means adapted to be movable within said track, said track engaging means being attached to said cable engaging means; and (c) means for propelling said track engaging means within said track to move said cable engaging means in said at least three different directions.

3. The invention of claim 2, wherein:

(a) said means for propelling comprises a hydraulic stroking cylinder with a telescoping arm attached to said track engaging means.

4. The invention of claim 3, wherein:

(a) said cable engaging means comprises a sheave.

5. The invention of claim 4, and further comprising:

(a) a housing means for enclosing said track, said track engaging means, and said cable engaging means said housing means including a top and a bottom, said cable extending through said housing means from top to bottom;

(b) a pair of guide means mounted within said housing for guiding said cable from one side to the bottom of said housing means;

(c) said track being positioned to align said sheave between said guide means during said movement in said first direction and to remove said sheave from alignment between said guide means during said movement in said second direction.

6. The invention of claim 5, wherein:

(a) each of said guide means comprises a stationary pulley.

7. The invention of claim 5, and further comprising:

(a) a drop hammer attached to said cable beneath said housing means, said drop hammer being raised and lowered with said cable.

8. The invention of claim 5, and further comprising:

(a) a winch means positioned above said housing to adjust the length of said cable below said housing.

9. The invention of claim 5, and further comprising:

(a) a stroke counter for counting the number of times that the cable is raised and released.

10. A free fall stroker apparatus for raising and dropping a drop hammer attached to a cable, comprising:

(a) a cable engaging means movable in at least three different directions, said cable engaging means engaging and raising the cable during motion in a first of said directions and releasing and dropping, wherein said first and second directions are non-reciprocal;

(b) a track;

(c) a track engaging means adapted to be movable within said track, said track engaging means being attached to said cable engaging means; and (d) means for propelling said track engaging means within said track to move said cable engaging means in said at least three directions.

11. The invention of claim 10 wherein:

(a) said means for propelling comprises a hydraulic stroking cylinder with a telescoping arm attached to said cable engaging means.

12. The invention of claim 11, wherein:

(a) said cable engaging means comprises a sheave.

13. The invention of claim 12, and further comprising:

(a) a housing for enclosing said track, said track engaging means, and said cable engaging means, said housing including a top, a bottom, and at least one side, said cable extending through said housing from said one side to the bottom thereof;

(b) a pair of guide pulleys mounted within said housing for guiding said cable from said side to the bottom of said housing;

(c) said track being positioned to align said sheave between said guide pulleys during said movement in said first direction and to remove said sheave from alignment between said guide pulleys during said movement in said second direction.

14. The invention of claim 13, wherein:

(a) said track is shaped as a parallelogram with a first leg extending in said first direction, a second leg extending in said second direction, a third leg parallel to said first leg and a fourth leg parallel to said second leg.

15. The invention of claim 13, and further comprising:

(a) a winch means positioned above said housing to adjust the length of said cable below said housing.

16. The invention of claim 13, and further comprising:

(a) a stroke counter for counting the number of times that the hammer is raised and released.

17. A free fall stroker apparatus for raising and dropping a drop hammer attached to a cable, comprising:

(a) a cable engaging sheave movable in a plurality of directions, said sheave engaging and raising said cable during motion in one direction and releasing and dropping said cable during motion in a second direction;

(b) a track shaped as a parallelogram with a first leg extending in said first direction, a second leg extending in said second direction, a third leg parallel to said first leg and a fourth leg parallel to said second leg;

(c) a track engaging means adapted to be movable within said track, said track engaging means being attached to said cable engaging means;

(d) a hydraulic stroking cylinder with a telescoping arm for propelling said track engaging means within said track to move said cable engaging means in said plurality of directions;

(e) a housing means for enclosing said free fall stroker, said cable extending through said housing from one side to the bottom thereof;

(f) a pair of guide pulleys mounted within said housing for guiding said cable from the side to the bottom of said housing;

(g) said track being positioned to align said sheave between said guide pulleys during said movement in said first direction and to remove said sheave from alignment between said guide pulleys during said movement in said second direction; wherein (h) said hydraulic cylinder is pivotally connected to said housing such that retracting said telescoping arm pulls said track engaging means in said first and second track legs in said first and second directions, respectively, and extending said telescoping arm pushes said track engaging means in said third and fourth legs in directions opposite to said first and second directions, respectively.

18. The invention of claim 17, and further comprising:

(a) a winch means positioned above said housing to adjust the length of said cable below said housing.

19. The invention of claim 17, and further comprising:

(a) a stroke counter for counting the number of times that the hammer is raised and released.

20. A method of raising and dropping a drop hammer attached to a cable, said method comprising the steps of:

(a) running the cable between a pair of guide means;

(b) moving a cable engaging means in one direction between the guide means to engage the cable and raise the hammer; and (c) moving the cable engaging means in a second direction which is non-reciprocal to said first direction to release the cable and thereby drop the hammer.

21. The method of claim 20, wherein said cable engaging means is attached to a track engaging means operating within a track which has first and second legs extending in said first and second directions, respectively, and said moving steps comprise:

(a) moving said track engaging means within first and second legs of said track in said first and second directions, respectively.

22. The method of claim 21, wherein said cable engaging means is attached to a telescoping arm of a hydraulic stroking cylinder, and said moving steps further comprise:

(a) retracting said telescoping arm to propel said cable engaging means in said first and second directions.

23. The method of claim 22, wherein said track is shaped as a parallelogram with a third leg parallel to said first leg and a fourth leg parallel to said second leg, said method further comprising:

(a) extending said telescoping arm to propel said cable engaging means in said third leg in a third direction opposite to said first direction, and in said fourth leg in a fourth direction opposite to said second direction to a point of origin.

24. A free fall stroker apparatus for raising and dropping a cable, comprising:

(a) a cable engaging means movable in a plurality of directions, said cable engaging means engaging and raising the cable during motion in a first direction and releasing and dropping said cable during motion in a second direction;

(a) a track shaped as a parallelogram with a first leg extending in said first direction, a second leg extending in said second direction, a third leg parallel to said first leg and a fourth leg parallel to said second leg;

(b) a track engaging means adapted to be movable within said track, said track engaging means being attached to said cable engaging means; and (c) means for propelling said track engaging means within said track to move said cable engaging means in said plurality of directions.

25. The invention of claim 24 wherein:

(a) said hydraulic cylinder is pivotally connected to said housing means such that retracting said telescoping arm pulls said track engaging means in said first and second track legs in said first and second directions, respectively, and extending said telescoping arm pushes said track engaging means in said third and fourth legs in directions opposite to said first and second directions, respectively.

26. A free fall stroker apparatus for raising and dropping a drop hammer attached to a cable, comprising:

(a) a cable engaging means movable in a plurality of directions, said cable engaging means engaging and raising the cable during motion in a first direction and releasing and dropping said cable during motion in a second direction;

(b) a track shaped as a parallelogram with a first leg extending in said first direction, a second leg extending in said second direction, a third leg parallel to said first leg and a fourth leg parallel to said second leg;

(c) a track engaging means adapted to be movable within said track, said track engaging means being attached to said cable engaging means; and (d) means for propelling said track engaging means within said track to move said cable engaging means in said plurality of directions.

27. The invention of claim 26, wherein:

(a) said hydraulic cylinder is pivotally connected such that retracting said telescoping arm pulls said track engaging means in said first and second track legs in said first and second directions, respectively, and extending said telescoping arm pushes said track engaging means in said third and fourth legs in directions opposite to said first and second directions, respectively.

28. The invention of claim 27, and further comprising:

(a) a winch means positioned above said housing to adjust the length of said cable below said housing.

29. A method of raising and dropping a drop hammer attached to a cable, said method comprising the steps of:

(a) running the cable between a pair of guide means;

(b) moving a cable engaging means via a parallelogram shaped track along a first track leg extending in a first direction between the guide means to engage the cable and raise the hammer;

(c) moving the cable engaging means along a second track leg in a second direction to release the cable and thereby drop the hammer; and (d) moving said cable engaging means along a third leg in a direction opposite to said first direction, and then along a fourth leg in a fourth direction opposite to said second direction to a point of origin.

* * * * *